US006064708A

United States Patent [19]

Sakamaki

[11] Patent Number: 6,064,708

[45] Date of Patent: May 16, 2000

[54] UNDERWATER INSPECTION/REPAIR APPARATUS

[75] Inventor: Kazuo Sakamaki, Yokohama, Japan

[73] Assignee: Kabushiki Kaisha Toshiba, Kawasaki, Japan

[21] Appl. No.: 09/116,602

[22] Filed: Jul. 17, 1998

[30] Foreign Application Priority Data

Jul. 17, 1997 [JP] Japan ..... 9-192548

[51] Int. Cl.[7] ..... G21C 17/00; B63B 59/00; B63G 8/00; E04H 4/16

[52] U.S. Cl. ..... 376/249; 376/245; 114/222; 114/313; 15/1.7

[58] Field of Search ..... 376/249, 245; 114/222, 313; 15/1.7

[56] References Cited

U.S. PATENT DOCUMENTS

| | | | |
|---|---|---|---|
| 4,591,477 | 5/1986 | Rettew | 376/204 |
| 5,193,405 | 3/1993 | Oomichi et al. | 73/865.8 |
| 5,211,125 | 5/1993 | Garland et al. | 114/222 |
| 5,513,930 | 5/1996 | Eathorne | 114/222 |
| 5,519,741 | 5/1996 | Suzuki et al. | 376/249 |
| 5,678,091 | 10/1997 | Daspit | 396/28 |
| 5,730,553 | 3/1998 | Miura et al. | 405/191 |
| 5,784,425 | 7/1998 | Morlan | 376/249 |
| 5,838,752 | 11/1998 | Shimamura | 376/260 |
| 5,852,984 | 12/1998 | Matsuyama et al. | 114/222 |
| 5,917,875 | 6/1999 | Tuzio et al. | 376/245 |
| 5,930,316 | 7/1999 | Kowdley et al. | 376/249 |

FOREIGN PATENT DOCUMENTS 403255347A 11/1991 Japan .

*Primary Examiner*—Michael J. Carone
*Assistant Examiner*—Frederick T. French, III
*Attorney, Agent, or Firm*—Foley & Lardner

[57] ABSTRACT

An underwater inspection/repair apparatus comprises a sealing device provided around an opening portion of a watertight vessel, a pushing mechanism provided to the watertight vessel, a water discharge pump provided to the watertight vessel for discharging water in an inside of the watertight vessel, and a compressed air supplying device for supplying a compressed air into the inside of the watertight vessel. A top end of the sealing device is pushed against an inner wall surface of the reactor vessel by a reaction force generated when the pushing member of the pushing mechanism is pushed against the reactor internal structure, so that the inside of the watertight vessel can be isolated in a watertight manner. The pneumatic water discharge pump includes a pneumatic pressure cylinder driven by a pneumatic pressure, and a water discharge cylinder cooperated with the pneumatic pressure cylinder. Accordingly, there can be provided an underwater inspection/repair apparatus which is able to conduct inspection/repair operations without a discharge of a core water from a reactor vessel.

13 Claims, 8 Drawing Sheets

UNDERWATER INSPECTION/REPAIR APPARATUS

BACKGROUND OF THE INVENTION

1. Field of the Invention

The present invention relates to an underwater inspection/repair apparatus and, more particularly, an underwater inspection/repair apparatus capable of conducting inspection/repair of an interior of a reactor vessel without discharging a water from the reactor vessel.

2. Description of the Related Art

A boiling water reactor as one type of a light water reactor has a configuration shown in FIG. 6, for example. In FIG. 6, a reference 60 denotes a reactor. The reactor 60 comprises a reactor pressure vessel 62 having a top removable cover 61. A core 64 consisting of a plurality of fuel assemblies 63, 63, . . . , 63 is provided in the reactor pressure vessel 62. Each of the fuel assemblies 63 includes a plurality of elongate fuel rods (not shown). Each of fuel rods is constructed by covering a uranium dioxide pellet with a cladding tube. A steam separator 65 is provided over the core 64 and then a steam dryer 66 is provided over the steam separator 65.

A plurality of control rods 67, 67, . . . , 67 are inserted into clearances between the fuel assemblies 63, 63, . . . , 63 to be movable along their longitudinal direction. These control rods 67, 67, . . . , 67 can be driven vertically by a control rod drive mechanism (CRD) 68. The control rod drive mechanism 68 has rods 69,69, . . . , 69 connected to the control rods 67, 67, . . . , 67 respectively. These rods 69, 69, . . . , 69 are inserted respectively into cylindrical housings (through pressure-vessel housings) 70,70, . . . , 70 which extend into the inside of the reactor pressure vessel 62 via a bottom portion of the reactor pressure vessel 62. Flanges 71, 71, . . . , 71 whose diameters are set larger than outer diameters of the housings 70 are provided to lower end portions of these housings 70, 70, . . . , 70 to fit a main body of the control rod drive mechanism.

A substantially cylindrical core shroud 72 is provided around the core 64. A plurality of jet pumps 73, 73, . . . , 73 are provided in clearances between the core shroud 72 and an inner wall of the reactor pressure vessel 62. A recirculation water inlet nozzle 74 and a recirculation water outlet nozzle 75 are provided on a side peripheral wall of the reactor pressure vessel 62 to pass through the vessel wall. The recirculation water inlet nozzle 74 and the recirculation water outlet nozzle 75 are connected via a recirculation loop 76 provided on the outside of the reactor pressure vessel 62. One end of the recirculation loop 76 is positioned so as to oppose to a nozzle 73*a* of the jet pump 73 via the recirculation water inlet nozzle 74. A reactor recirculation pump 77 is interposed in the middle of the recirculation loop 76.

A main steam outlet nozzle 79 is provided on a side peripheral wall of the reactor pressure vessel 62 to pass through the vessel wall. A main steam pipe 81 is connected to the reactor pressure vessel 62. A through pressure-vessel nozzle 78 for measuring a water level is also provided on the side peripheral wall of the reactor pressure vessel 62 to pass through the vessel wall. FIG. 7 shows details around the through pressure-vessel nozzle 78. As can be seen from FIG. 7, a cladding portion 82 made of stainless steel is formed by welding on an inner wall surface of the reactor pressure vessel 62. A welded portion 83 made of inconel alloy which is excellent in both heat resistance and corrosion resistance is formed on the end portion of the through pressure-vessel nozzle 78 on the core 64 side.

An inside of the reactor pressure vessel 62 is filled with a core water (light water) W such that the core 64 is sufficiently covered with the water W. The core water W can function as moderator and coolant of the reactor 60.

As shown in FIG. 8, a fuel exchanger 84 which performs mainly exchange and replacement of the fuel assemblies 63 is provided over the reactor pressure vessel 62. When the fuel assemblies 63 are exchanged by using the fuel exchanger 84, the top removable cover 61 of the reactor pressure vessel 62 is removed.

In the boiling water reactor having the above configuration, heat can be generated by fission reaction of uranium in the fuel rods constituting the fuel assemblies 63 and then a core water W can be boiled by such heat. The boiled core water W can be separated into steam and water by virtue of the steam separator 65. Then, the separated steam can be dried by virtue of the steam dryer 66 and then supplied to a steam turbine (not shown) via the main steam outlet nozzle 79 and the main steam pipe 81. The steam, when supplied to the steam turbine, can drive the steam turbine. The steam can then be condensed by the condenser (not shown), and then can be circulated back into an inside of the reactor pressure vessel 62 via a water feed pipe (not shown) and a water feed nozzle (not shown).

Meanwhile, the core water W, when supplied to the nozzles 73*a* of the jet pumps 73 by the reactor recirculation pump 77, is pressurized downward by the jet pumps 73 to enter into the bottom portion of the core 64, and then the flow of the core water W is changed upward to flow into the inside of the core 64. The core water W can be circulated effectively by using the jet pumps 73 in this manner. The control rod drive mechanism 68 can insert and pull out the control rods 67, 67, . . . , 67 by moving the rods 69, 69, . . . , 69 vertically by means of hydraulic pressure drive, for example, so that it can control the output of the reactor 60 by absorbing neutrons emitted by nuclear fission.

However, for example, if austenitic stainless steels (e.g., SUS 304, etc.) are employed as material for the through pressure-vessel nozzle 78, there has been such a possibility that, under certain conditions, stress corrosion crackings (SCCs) occur in the welded portion between the through pressure-vessel nozzle 78 and the reactor pressure vessel 62 or in the through pressure-vessel nozzle 78 in vicinity of the welded portion.

Such stress corrosion crackings may be caused when three factors, i.e., sensitization of material (i.e., a phenomenon that a chromium depletion layer is generated in the neighborhood of grain boundary because of heat affection of the welding to thus degrade corrosion resistance), welding residual stress caused in the welded portion, and high temperature core water environment including a very small amount of dissolved oxygen are superposed.

Accordingly, the stress corrosion crackings can be prevented by reducing the degrees of the above three factors or eliminating more than one of above three factors, and therefore various countermeasures have already been taken. There have been possibilities that rust, crackings, etc. are generated in the inner surface of the through pressure-vessel nozzle 78, etc. due to any causes in addition to the above stress corrosion crackings.

In the related art, if crackings are generated in the through pressure-vessel nozzle 78, etc. because of the above stress corrosion crackings and other causes, the core water W filled in the reactor pressure vessel 62 has had to be discharged from the reactor pressure vessel 62 to carry out the repair operation. Then, after the core water W has been discharged, the operators have performed disconnection of the pipes, etc. from the outside of the reactor pressure vessel 62.

In this manner, since the related art repair operation has had to be conducted after the core water W filled in the reactor pressure vessel 62 has been discharged therefrom, not only longer hours have been required for a working time, but also a dose rate has been increased in the working environment because of loss of the radiation shielding effect obtained by the core water W. As a result, it has been extremely difficult to perform the repair operation quickly with regard to the permissible exposure doze for the operator.

SUMMARY OF THE INVENTION

Therefore, it is an object of the present invention to provide an underwater inspection/repair apparatus capable of conducting an inspection/repair operation without discharging a water from a water vessel as an inspection object.

According to the present invention, there is provided an underwater inspection/repair apparatus comprising a watertight vessel formed by a hollow member; an opening portion formed on the watertight vessel; a sealing device provided around the opening portion; a pushing mechanism provided to the watertight vessel; a water discharge pump for discharging water in an inside of the watertight vessel; and a compressed air supplying means for supplying a compressed air into the inside of the watertight vessel; wherein the pushing mechanism has a pushing member which can be pushed against a supporting structure positioned behind a back surface of the sealing device, and a top end portion of the sealing device is pushed against an inner wall surface of a water vessel as an inspection object by a reaction force generated when the pushing member is pushed against the supporting structure, whereby the inside and an outside of the watertight vessel can be isolated in a watertight manner.

Preferably, the water discharge pump is made up of a pneumatic water discharge pump provided to the watertight vessel.

Preferably, the pneumatic water discharge pump includes a pneumatic pressure cylinder driven by a pneumatic pressure, and a water discharge cylinder cooperated with the pneumatic pressure cylinder, and a water which is sucked into the water discharge cylinder from the inside of the watertight vessel is discharged to the outside of the watertight vessel by reciprocating the pneumatic pressure cylinder as well as the water discharge cylinder.

Preferably, the pneumatic water discharge pump has a piston rod which is commonly used as the pneumatic pressure cylinder and the water discharge cylinder, and an air connecting flow path for connecting a pushing side internal space of the pneumatic pressure cylinder and a pushing side internal space of the water discharge cylinder is formed in the piston rod to enhance a pump operating efficiency of the pneumatic water discharge pump.

Preferably, the water discharge cylinder has a suction side check valve and a discharge side check valve for regulating a water flow in an opposite direction respectively, and the water in the inside of the watertight vessel can be sucked into an inside of the water discharge cylinder via the suction side check valve and then discharged to the outside of the watertight vessel via the discharge side check valve.

Preferably, a compressed air for driving the pneumatic pressure cylinder is supplied via a switching valve which is switched by a switching operation generated by a timer.

Preferably, the sealing device is detachably attached to the watertight vessel.

Preferably, the top end portion of the sealing device is formed to be curved in answer to a curved shape of the inner wall surface of the water vessel as the inspection object, a plurality of ring-shape sealing members are provided in a concentric manner to the top end portion, and a pneumatic pressure sealing is formed by supplying a compressed air into a space between the sealing members.

Preferably, the pushing mechanism is made up of a fluid pressure cylinder, and the pushing member comprises an output rod of the fluid pressure cylinder.

Preferably, the pushing mechanism further comprises a mechanical jack, which has a pushing rod which can be driven mechanically back and forth relative to the supporting structure, as back-up means used when a pushing operation generated by the output rod of the fluid pressure cylinder is lost.

Preferably, the water vessel as the inspection object is a reactor vessel and has further a radiation shield body arranged in a clearance between an outer peripheral surface of a core shroud and an inner wall surface of the reactor vessel, and the pushing member of the pushing mechanism is pushed against a surface of the radiation shield body arranged at a predetermined position in the reactor vessel.

Preferably, an underwater inspection/repair apparatus further comprises a ring-shape member arranged in the water vessel as the inspection object, and a receiving plate fixed to the ring-shape member, and the pushing member of the pushing mechanism is pushed against a surface of the receiving plate of the ring-shape member which is arranged at a predetermined position in the water vessel as the inspection object.

Preferably, a discharge port for discharging an air and the water in the watertight vessel is formed on the watertight vessel.

DETAILED DESCRIPTION OF THE PREFERRED EMBODIMENTS

An underwater inspection/repair apparatus according to an embodiment of the present invention will be explained in detail with reference to FIGS. 1 to 5 hereinafter. A water vessel serving as an inspection object which is inspected by the underwater inspection/repair apparatus according to an embodiment of the present invention is a reactor pressure vessel of a boiling water reactor.

Figure 1:
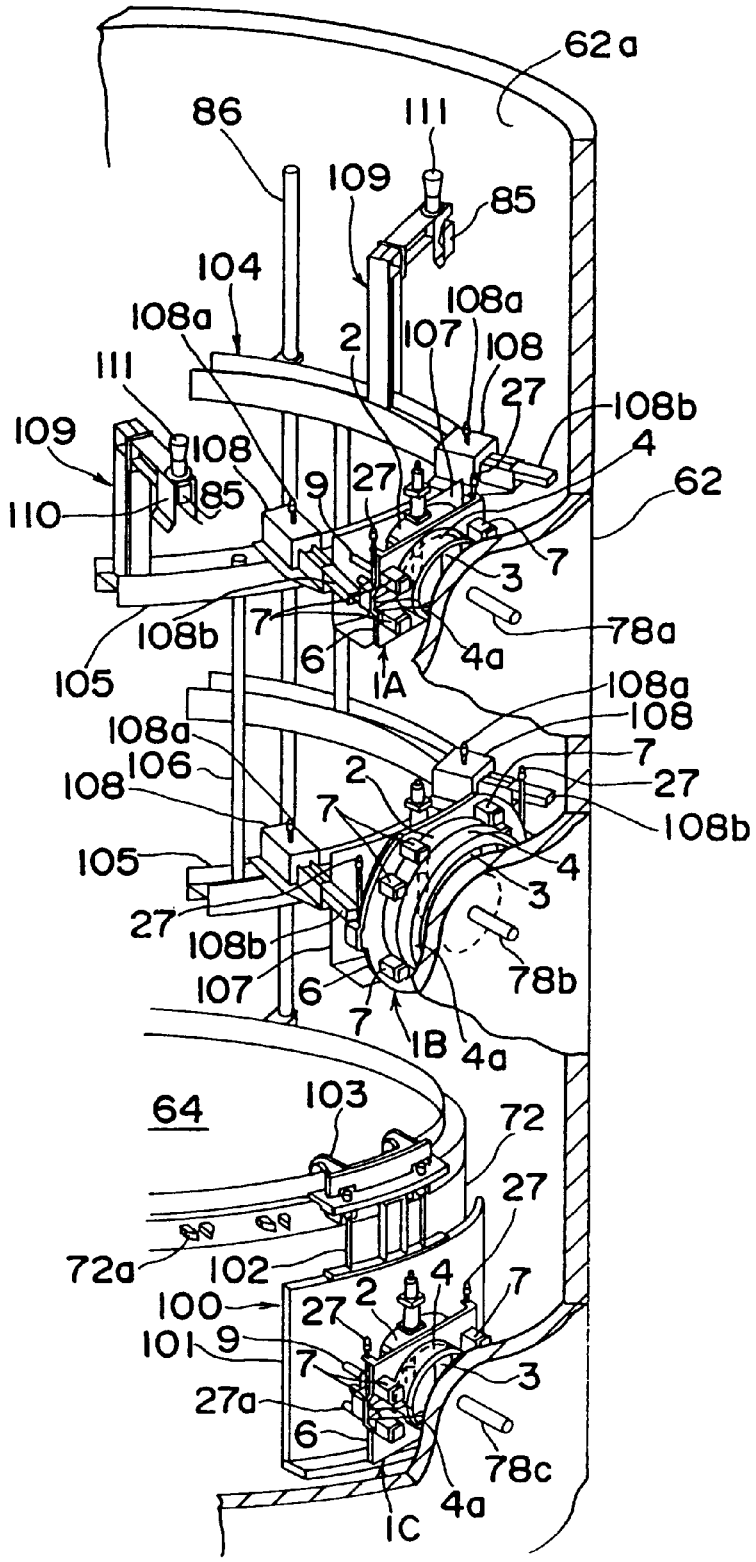
FIG. 1 is a perspective view showing three underwater inspection/repair apparatus according to an embodiment of the present invention which are installed in a reactor pressure vessel of a boiling water reactor.
Figure 2:
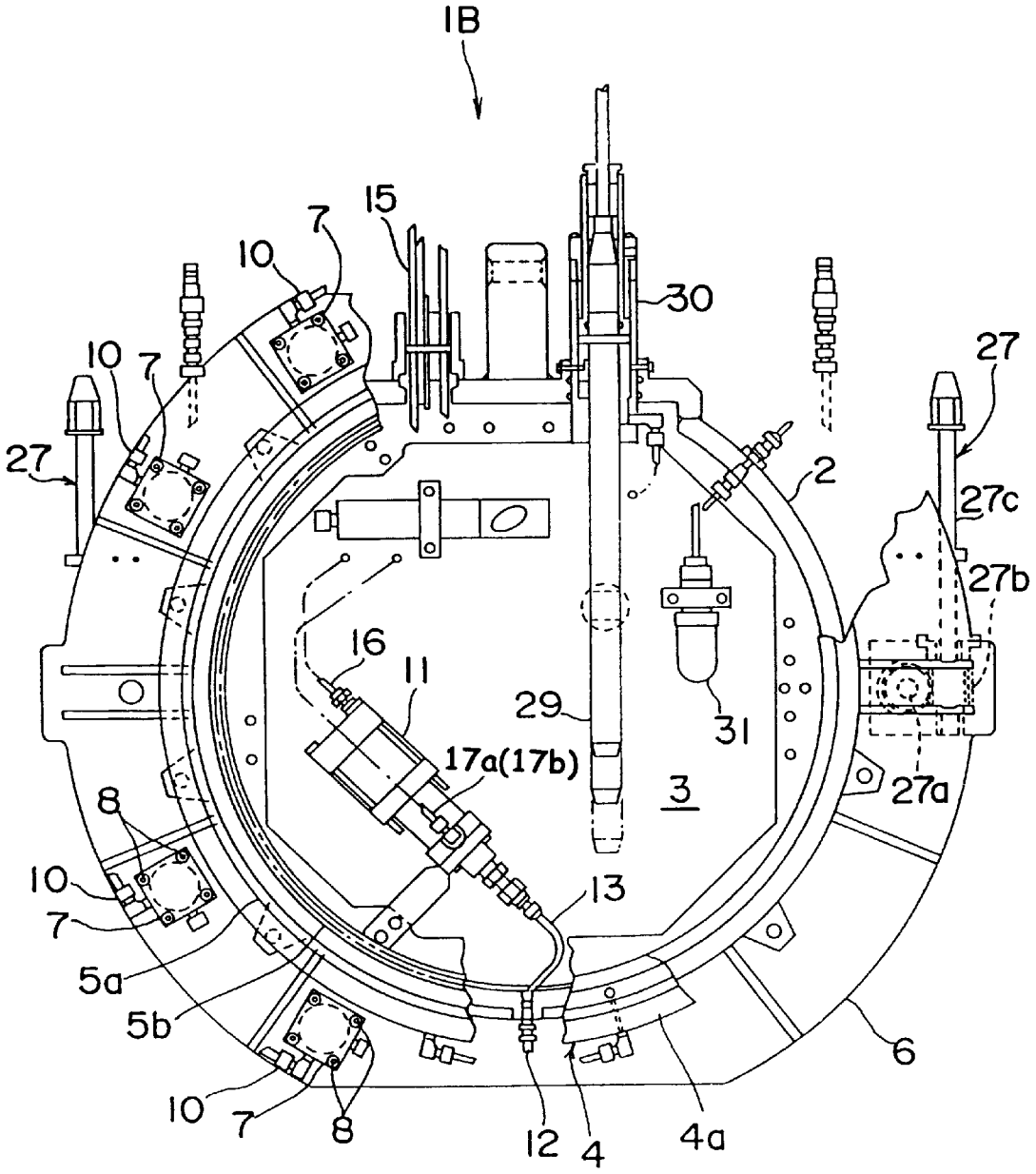
FIG. 2 is a front view showing a middle underwater inspection/repair apparatus of three underwater inspection/repair apparatus shown in FIG. 1.

FIG. 1 is a perspective view showing the case where the underwater inspection/repair apparatus according to the embodiment of the present invention are installed into the inside of the reactor pressure vessel (water vessel as the inspection object) 62 of the boiling water reactor. As shown in FIG. 1, three underwater inspection/repair apparatus 1A, 1B, 1C are placed on different positions in the vertical direction in the inside of the reactor pressure vessel 62 respectively. FIG. 2 is a front view showing the middle underwater inspection/repair apparatus 1B of three underwater inspection/repair apparatus shown in FIG. 1.

The uppermost underwater inspection/repair apparatus 1A is positioned at a position corresponding to a first through pressure-vessel nozzle 78*a* which is positioned higher than a core water level in normal operation. The middle underwater inspection/repair apparatus 1B is positioned at a position corresponding to a second through pressure-vessel nozzle 78*b* which is positioned lower than the core water level in normal operation. The first through pressure-vessel nozzle 78*a* and the second through pressure-vessel nozzle 78*b* are water level measuring nozzles to measure the core water level in normal operation. The lowermost underwater inspection/repair apparatus 1C is positioned at a position corresponding to a third through pressure-vessel nozzle 78*c* which is positioned equally to a height of the top portion of the core 64.

As shown in FIGS. 1 and 2, the underwater inspection/repair apparatus 1A, 1B, 1C include a watertight vessel 2 made of a hollow member respectively. An opening portion 3 is formed on each of the watertight vessels 2. A short cylinder type sealing device 4 is formed 3 0 around the opening portion 3 so as to project therefrom. A top end portion 4*a* of the sealing device 4 is formed to be curved such that it can correspond to a curved shape of an inner wall surface 62*a* of the reactor pressure vessel 62.

The uppermost underwater inspection/repair apparatus 1A and the lowermost underwater inspection/repair apparatus 1C have the same configuration, but these underwater inspection/repair apparatus 1A, 1C have partially different in configuration from the middle underwater inspection/repair apparatus 1B. For instance, the watertight vessel 2 and the opening 3 thereof in the middle underwater inspection/repair apparatus 1B are set larger in dimension than those of the underwater inspection/repair apparatus 1A, 1C. The reason why dimensions of the watertight vessel 2 and the opening 3 thereof in the middle underwater inspection/repair apparatus 1B are set larger is that sealing must be performed so as to avoid positions of the clad patches, which are projected from the inner wall surface 62*a* of the reactor pressure vessel 62 near the second through pressure-vessel nozzle 78 to identify inspected locations in the in-service inspection (ISI). However, differences between the uppermost and lowermost underwater inspection/repair apparatus 1A, 1C and the middle underwater inspection/repair apparatus 1B are not essential but their basic configurations and functions are identical to each other.

As shown in FIG. 2, a pair of ring-like sealing members 5*a*, 5*b* are provided in a concentric manner on the top end portions 4*a* of the sealing devices 4 of the underwater inspection/repair apparatus 1A, 1B, 1C. Thus, the top end portions 4*a* of the sealing devices 4 can be brought in watertight contact with curved shapes of the inner wall surface 62*a* of the reactor pressure vessel 62 via these ring-like sealing members 5*a*, 5*b*.

A pedestal plate 6 is provided to the watertight vessel 2 to protrude to the sideward. A plurality of fluid pressure cylinders 7 acting as pushing mechanisms respectively are fixed to the pedestal plate 6 by bolts 8. In the uppermost and lowermost underwater inspection/repair apparatus 1A and 1C, four fluid pressure cylinders 7 are provided in total at four comers of the square pedestal plate 6 respectively. In contrast, in the middle underwater inspection/repair apparatus 1B, eight fluid pressure cylinders 7 are provided in total bilateraly and vertically symmetrically to the substantially circular pedestal plate 6.

Each of the fluid pressure cylinders 7 has an output rod 9 serving as a pushing member, and a rotatable spherical member (not shown) is provided to a top end of the output rod 9. The rotatable spherical member, when driven forth by the output rod 9 to be brought into contact with a surface of a reactor internal structure, can rotate on the surface of the reactor internal structure, so that a stable contact surface with respect to the curved surface can be maintained. The output rods can be driven respectively by supplying the water or the air from supply ports 10 of the fluid pressure cylinders 7.

As shown in FIG. 2, the pneumatic water discharge pump 11 is provided in the inside of the watertight vessel 2 in the middle underwater inspection/repair apparatus 1B. The pneumatic water discharge pump is driven by compressed air which is supplied through a pair of working air supply lines 17*a*, 17*b*. This pneumatic water discharge pump 11 is used to discharge the core water in the watertight vessel 2 or discharge the compressed air being supplied to the inside of the watertight vessel 2.

A core water suction portion 12 is provided to an inner bottom portion of the watertight vessel 2. The core water suction portion 12 is connected to a suction port of the pneumatic water discharge pump 1 1 via a suction line 13. The core water, when being sucked from the core water suction portion 12 and the suction line 13 into the pneumatic water discharge pump 11, can be discharged to the outside of the watertight vessel 2 via the outlet port of the pneumatic water discharge pump 11 and the water discharge line 16 connected to the outlet port, and then transferred to an operation floor region (not shown).

Figure 3B:
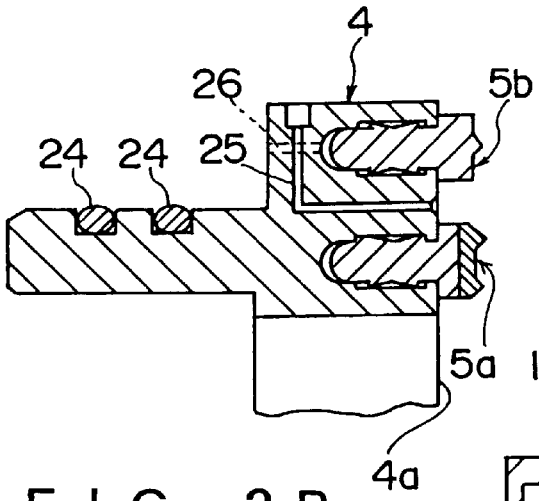
FIG. 3B is an enlarged vertical sectional view showing a sealing portion of a sealing device of the underwater inspection/repair apparatus shown in FIG. 3A.
Figure 3A:
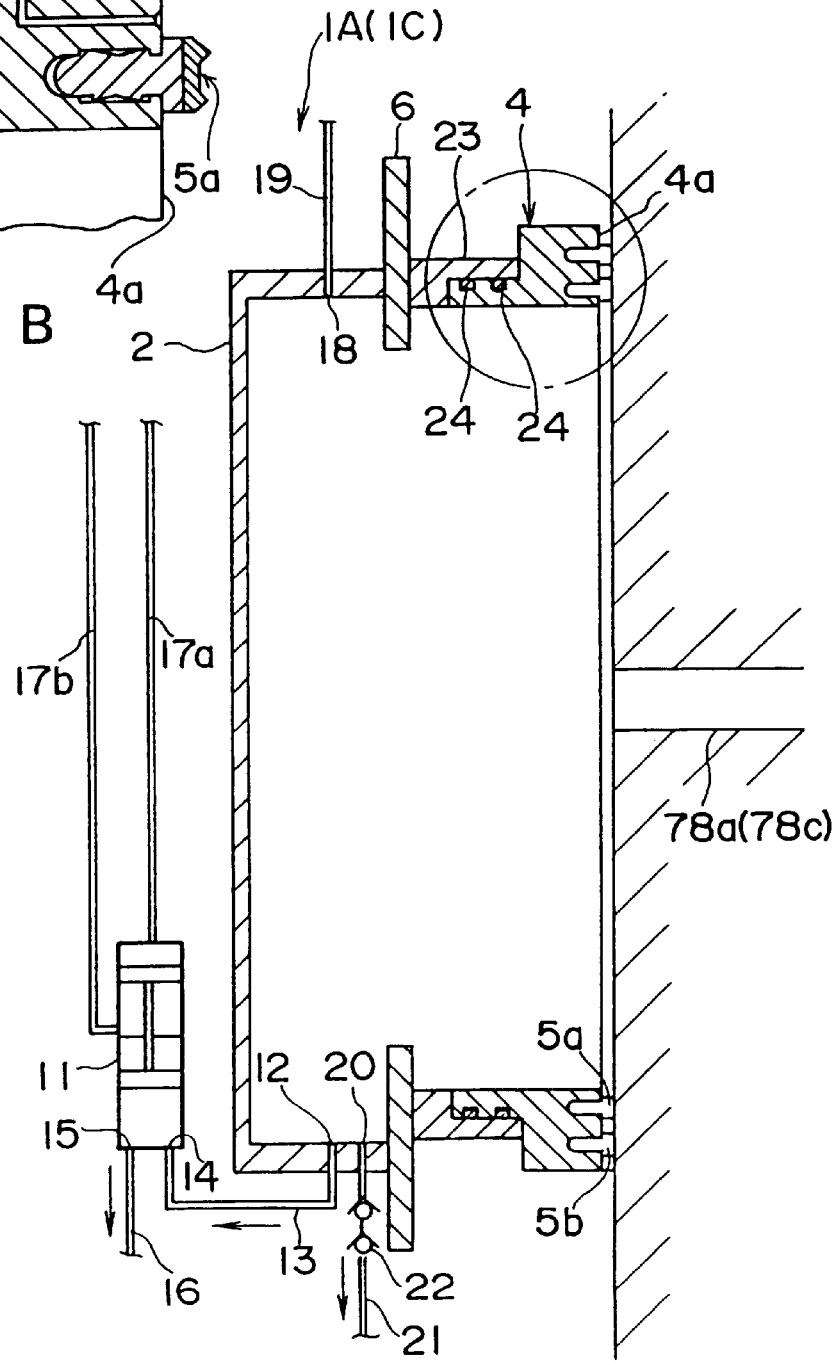
FIG. 3A is a vertical sectional view showing uppermost or lowermost underwater inspection/repair apparatus of three underwater inspection/repair apparatus shown in FIG. 1.

FIG. 3A is a vertical sectional view showing the uppermost or lowermost underwater inspection/repair apparatus 1A, 1C of three underwater inspection/repair apparatus shown in FIG. 1. As can be seen from FIG. 3A, in the uppermost and lowermost underwater inspection/repair apparatus 1A and 1C, the pneumatic water discharge pumps 11 are fitted to the pedestal plate 6 on the outside of the watertight vessel 2. This is because it is difficult to arrange the pneumatic water discharge pump 11 in the inside of the watertight vessel 2 since inner spaces of the watertight vessels 2 in the uppermost and lowermost underwater inspection/repair apparatus 1A and 1C are relatively small.

As shown in FIG. 3A, the pneumatic water discharge pumps 11 have the suction port 14 and the discharge port 15 respectively. The suction line 13 is connected to the suction port 14 and the water discharge line 16 is connected to the discharge port 15. A pair of working air supply lines 17*a*, 17*b* for supplying the pump driving compressed air to the pneumatic water discharge pump 11 are connected to the pneumatic water discharge pump 11.

As shown in FIG. 3A, a compressed air supply port 18 is formed on the top portion of the watertight vessel 2 to supply the compressed air to the inside of the watertight vessel 2. A compressed air supply line 19 is connected to the compressed air supply port 18. While, a discharge port 20 is formed on a bottom portion of the watertight vessel 2 to discharge the core water and the compressed air contained in the watertight vessel 2. A core water discharge line 21 is connected to the discharge port 20. A check valve 22 is provided in the middle of the core water discharge line 21. The core water discharged from the discharge port 20 is passed through the check valve 22 and then transferred to the operation floor region via the core water discharge line 21.

As shown in FIG. 3A, a fitting flange 23 is provided to the watertight vessel 2. As shown in FIG. 3B, the sealing device 4 can be put into the fitting flange 23 watertightly and attachably/detachably via a pair of O-rings 24. Since the sealing device 4 can be detachably attached to the watertight vessel 2, the sealing device 4 having a most suitable top end shape to mate with an inner diameter of the reactor pressure vessel 62 can be selected appropriately and then fitted to the watertight vessel 2.

As shown in FIG. 3B, their contact surfaces of an inner ring-shape sealing member 5*a* and an outer ring-shape sealing member 5*b* are different and also both sealing members 5*a* and 5*b* are different in material. More particularly, the inner ring-shape sealing member 5*a* is made of silicon material, but the outer ring-shape sealing member 5*b* is made of nitrile rubber. In addition, in the inner ring-shape sealing member 5*a*, the contact portion is formed of material which is soft rather than other portions.

If the inner ring-shape sealing member 5*a* and the outer ring-shape sealing member 5*b* are different in material and shapes, such situation can be prevented that sealing functions of both the inner ring-shape sealing member 5*a* and the outer ring-shape sealing member 5*b* are lost simultaneously because of the common cause.

An air flow path 25 is formed between the inner ring-shape sealing member 5*a* and the outer ring-shape sealing member 5*b* in the sealing device 4, so that the compressed air can be supplied into a space between the inner ring-shape sealing member 5*a* and the outer ring-shape sealing member 5*b* via the air flow path 25. Therefore, an air seal can be formed by supplying the compressed air to the space between the inner ring-shape sealing member 5*a* and the outer ring-shape sealing member 5*b*, whereby a sealing effect can be enhanced by the sealing device 4.

In addition, an air flow path 26 is formed in the sealing device 4 to supply the compressed air to the back side of the outer ring-shape sealing member 5*b*, so that a sealing effect of the outer ring-shape sealing member 5*b* can be enhanced because of a back purge pressure caused by the compressed air by supplying the compressed air to the back side of the outer ring-shape sealing member 5*b* via the air flow path 26.

As shown in FIGS. 1 and 2, mechanical jacks 27 are fitted to right and left end portions of the pedestal plate 6. These mechanical jacks 27 comprise a pushing rod 27*a* which can be driven back and forth mechanically, a gear 27*b* for driving back and forth the pushing rod 27*a*, and an actuating rod 27*c* respectively. These mechanical jacks 27 are employed as a back-up means respectively when pushing operations generated by the output rods 9 of the fluid pressure cylinders 7 are lost by any reason.

As shown in FIG. 2, an underwater TV camera 29 is incorporated into the watertight vessel 2 to be slid by a camera moving cylinder 30. Also, a lighting system 31 is provided in vicinity of the underwater TV camera 29.

Figure 4:
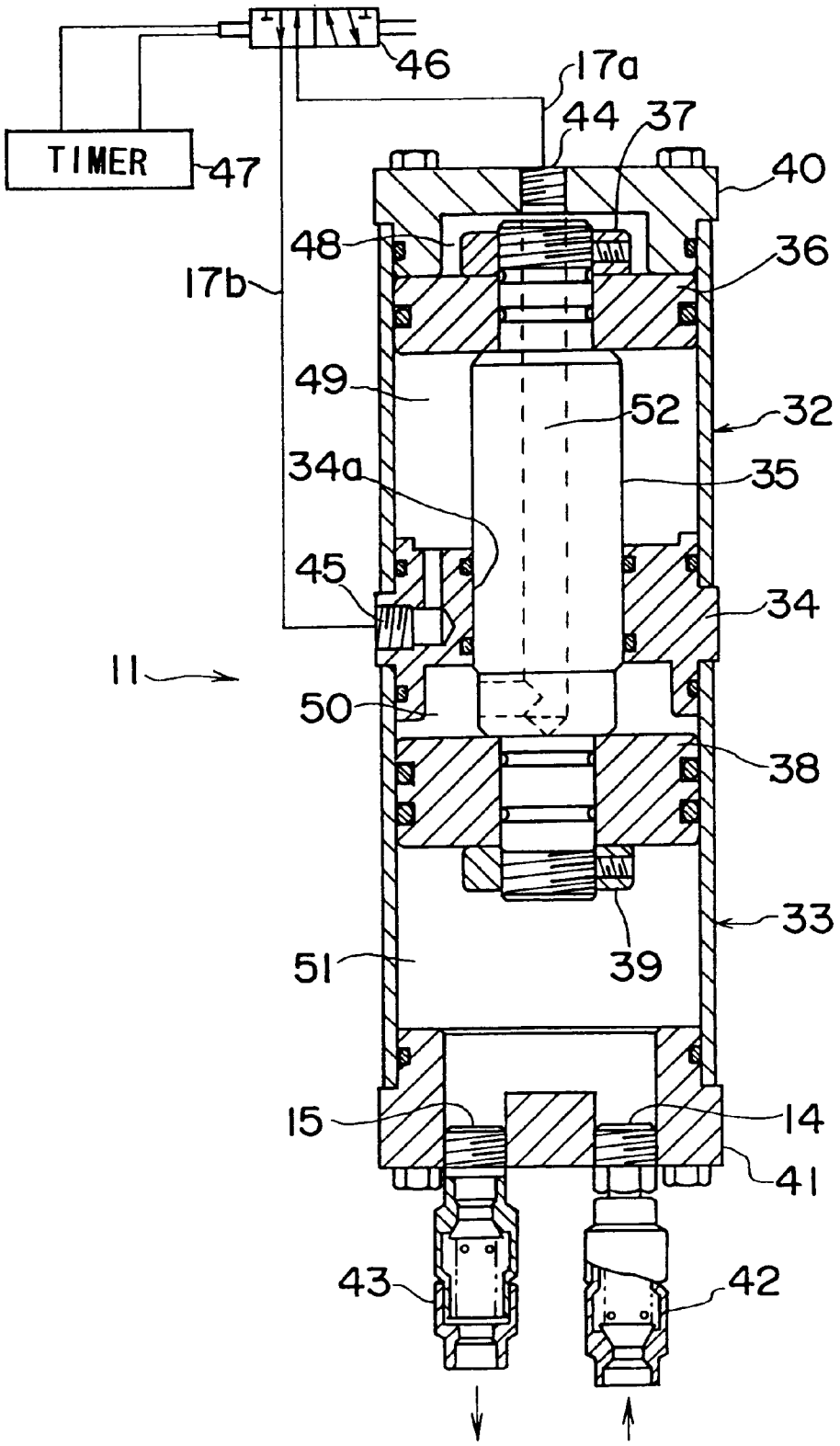
FIG. 4 is a vertical sectional view showing an inner configuration of a pneumatic water discharge pump in the underwater inspection/repair apparatus according to the embodiment of the present invention.

FIG. 4 is a vertical sectional view showing an inner configuration of the pneumatic water discharge pump 11 installed on the outside or the inside of the watertight vessel 2 in the underwater inspection/repair apparatus 1A, 1B, 1C. As shown in FIG. 4, the pneumatic water discharge pump 11 comprises a pneumatic cylinder 32 which is driven by pneumatics, and a water discharge cylinder 33 which is cooperated with the pneumatic cylinder 32. These cylinders 32,33 are connected via an intermediate body 34.

Further, the pneumatic water discharge pump 11 has a piston rod 35 which is commonly used as a pneumatic cylinder 32 and a water discharge cylinder 33. This piston rod 35 is fitted slidably and airtightly into a through hole 34*a* formed in the intermediate body 34.

A piston ring 36 is provided slidably in the pneumatic cylinder 32. This piston ring 36 is fixed to one end of the piston rod 35 by a fixing nut 37. A piston ring 38 is provided vertically slidably in the water discharge cylinder 33. This piston ring 38 is fixed to the other end of the piston rod 35 by a fixing nut 39.

An opening end of the pneumatic water discharge pump 11 on the pneumatic cylinder 32 side is tightly sealed by a top head 40, while an opening end of the pneumatic water discharge pump 11 on the water discharge cylinder 33 side is tightly sealed by a bottom head 41. A suction port 14 and a discharge port 15 are formed on the bottom head 41. A suction side check valve 42 is attached to the suction port 14 and a discharge side check valve 43 is attached to the discharge port 15.

The suction side check valve 42 and the discharge side check valve 43 can regulate the water flow respectively in the opposite direction. The core water in the watertight vessel 2 can be sucked into the water discharge cylinder 33 via the suction side check valve 42 and then the sucked core water can be discharged to the outside of the watertight vessel 2 via the discharge side check valve 43.

A first working air supply port 44 is formed on the top head 40. A working air supply line 17*a* is connected to the first working air supply port 44. Then, a second working air supply port 45 is formed on the intermediate body 34. A working air supply line 17*b* is connected to the second working air supply port 45. The working air supply lines 17*a*, 17*b* are connected to a switching valve 46. The compressed air can be supplied alternatively to the first working air supply port 44 and the second working air supply port 45 by switching this switching valve 46 by means of a timer 47.

An internal space of the pneumatic cylinder 32 can be partitioned into a pushing side internal space 48 and a pulling side internal space 49 by the piston ring 36. The pushing side internal space 48 is a space into which the compressed air is supplied when the piston rod 35 is pushed out, and the pulling side internal space 49 is a space into which the compressed air is supplied when the piston rod 35 is pulled in. Also, an internal space of the water discharge cylinder 33 can be partitioned into a pushing side internal space 50 and a core water side internal space 51 by the piston ring 38. The pushing side internal space 50 is a space which is reduced when the core water is sucked into the water discharge cylinder 33, and the core water side internal space 51 is a space into which the core water is sucked.

In order to enhance a pump operating efficiency of the pneumatic water discharge pump 11, an air connecting flow path 52 is formed in the piston rod 35 so as to connect the pushing side internal space 48 of the pneumatic cylinder 32 and the pushing side internal space 50 of the water discharge cylinder 33. The function of this air connecting flow path 52 will be discussed in the following.

As mentioned above, reciprocating motions of the piston rod 35, the piston ring 36, and the piston ring 38 can be enabled by switching the switching valve 46 by using the timer 47.

The compressed air is supplied into the pushing side internal space 48 of the pneumatic cylinder 32 when the piston rod 35 is pushed out from the state shown in FIG. 4. At this time, the compressed air being supplied into the pushing side internal space 48 is also fed into the pushing side internal space 50 of the water discharge cylinder 33 via the air connecting flow path 52.

Then, pressure of the compressed air is applied to both the piston ring 36 and the piston ring 38 and then a pushing force for pushing out the piston ring 38 can be increased about twice. Hence, the piston ring 38 can be driven quickly, so that the core water in the core water side internal space 51 of the water discharge cylinder 33 can be discharged quickly via the discharge port 15 and the discharge side check valve 43.

On the contrary, the compressed air is supplied into the pulling side internal space 49 of the pneumatic cylinder 32 when the piston rod 35 is pulled in to push up the piston rod 35, the piston ring 36 and the piston ring 38.

At that time, the air in the pushing side internal space 50 of the water discharge cylinder 33 can be compressed. However, because the pushing side internal space 50 is connected to the pushing side internal space 48 of the pneumatic cylinder 32, the air compressed in the pushing side internal space 50 can be moved into the pushing side internal space 48 of the pneumatic cylinder 32 and then discharged to the outside via the first working air supply port 44 and the working air supply line 17*a*.

As described above, according to the pneumatic water discharge pump 11, the twice air pressure can be applied when the core water is pushed out from the core water side internal space 51 of the water discharge cylinder 33 whereas the air contained in the pushing side internal space 50 of the water discharge cylinder 33 can be discharged when the core water is pulled into the core water side internal space 51. Therefore, the pump operating efficiency of the pneumatic water discharge pump 11 can be significantly improved so that a discharge operation of the core water in the watertight vessel 2 can be quickly carried out.

Figure 5:
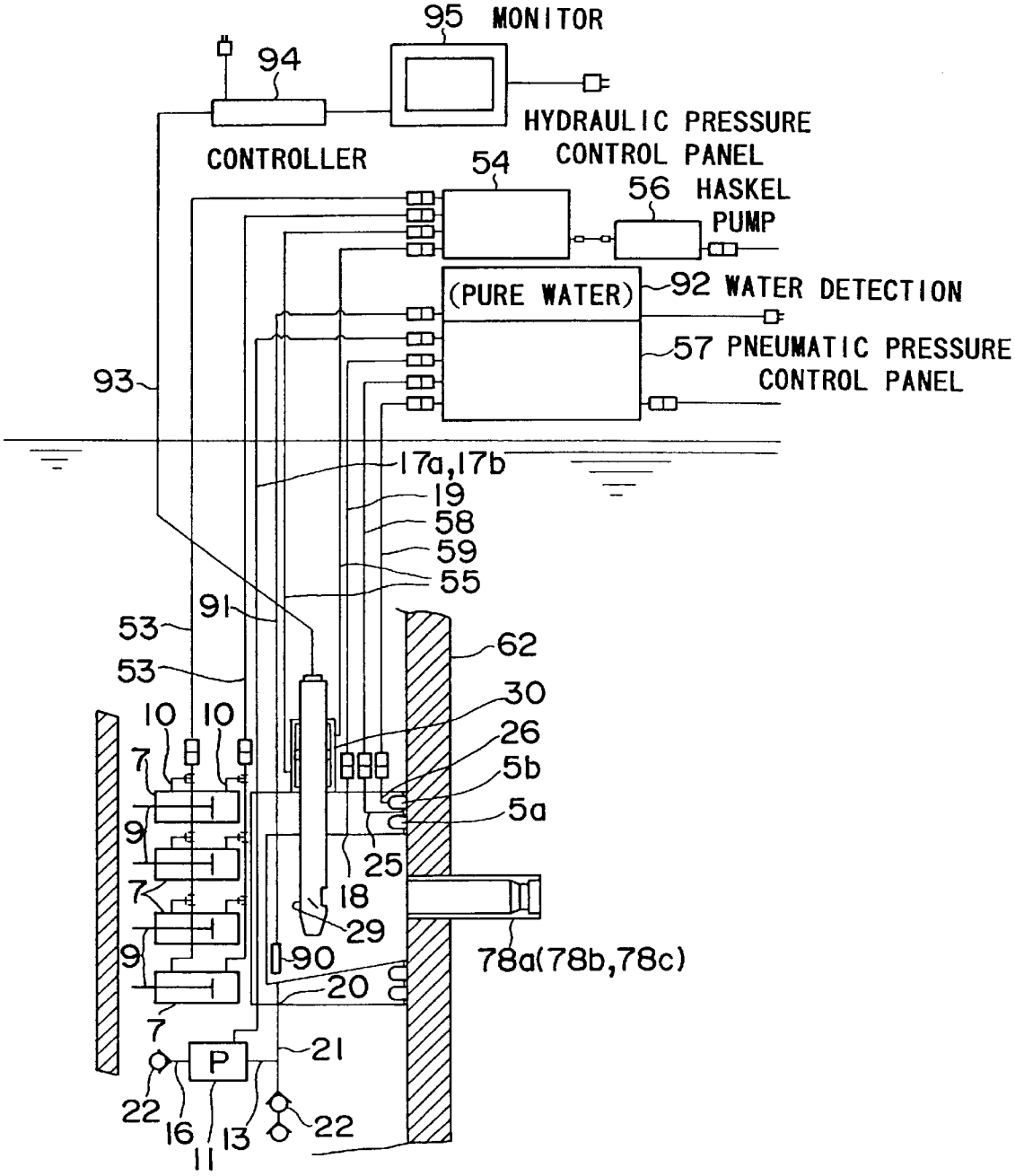
FIG. 5 is a schematic system diagram showing a piping system of the underwater inspection/repair apparatus according to the embodiment of the present invention.
Figure 6:
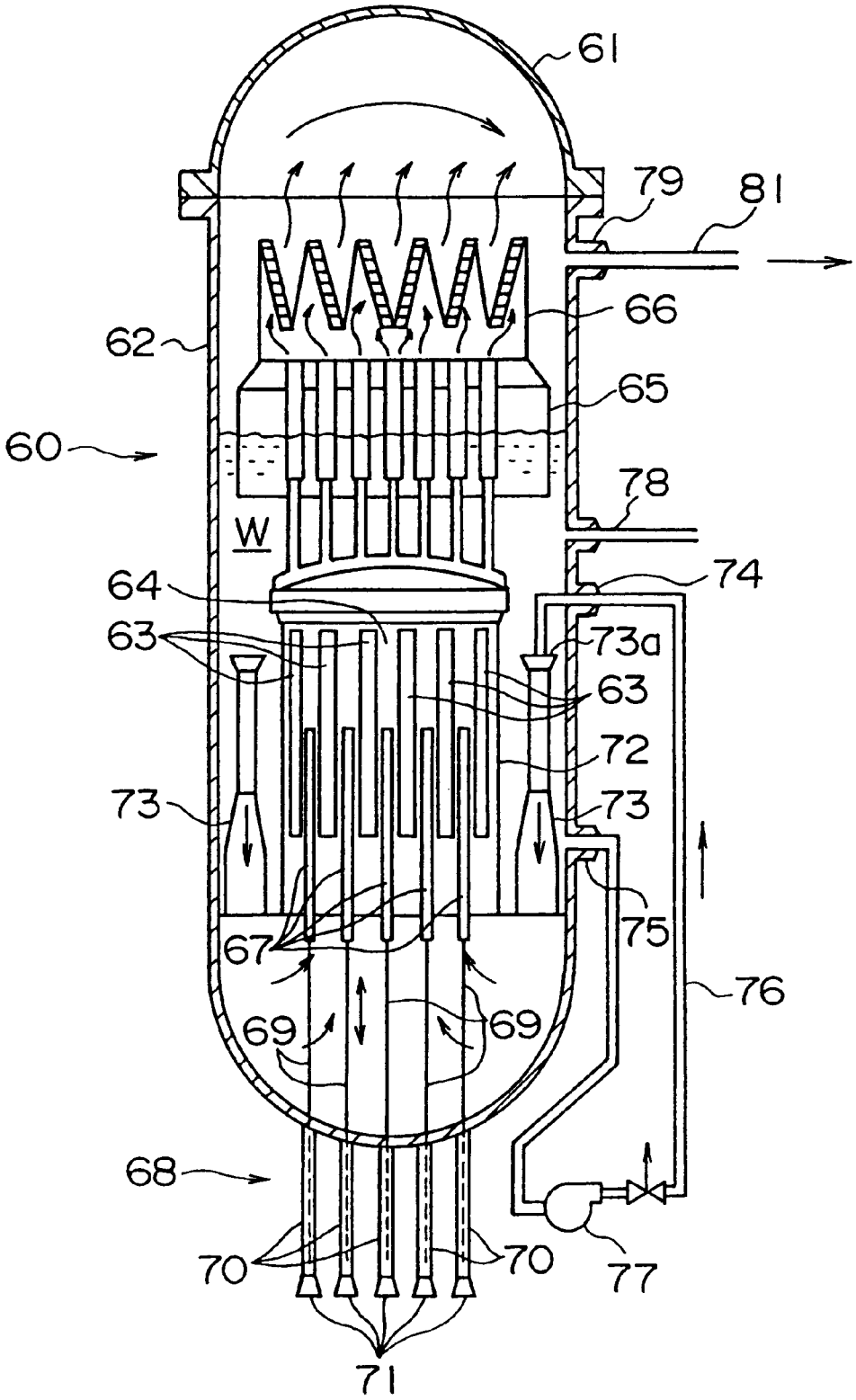
FIG. 6 is a vertical sectional view showing a schematic configuration of a boiling water reactor.
Figure 7:
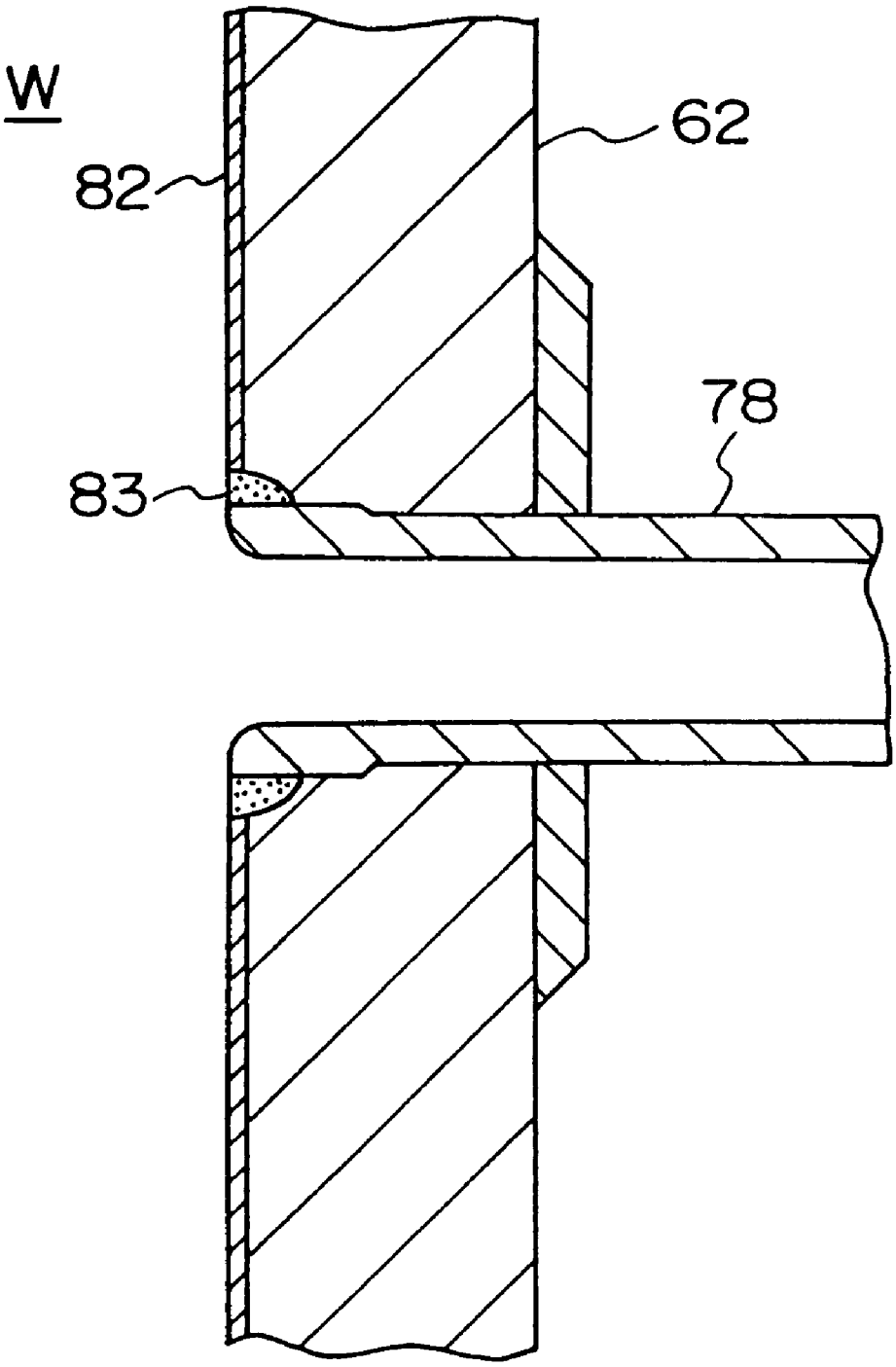
FIG. 7 is an enlarged sectional view showing a through pressure-vessel nozzle portion of the boiling water reactor.

FIG. 5 is a schematic system diagram showing a piping system of the underwater inspection/repair apparatus according to the embodiment of the present invention. As shown in FIG. 5, a supply port 10 of the fluid pressure cylinder 7 is connected to a hydraulic pressure control panel 54 via a hydraulic pressure supply line 53. The camera moving cylinder 30 is also connected to the hydraulic pressure control panel 54 via a hydraulic pressure supply line 55. A haskel pump 56 is also connected to the hydraulic pressure control panel 54.

The pneumatic water discharge pump 11 is connected to a pneumatic pressure control panel 57 via the working air supply lines 17*a*, 17*b*. The compressed air supply port 18 on the top of the watertight vessel 2 is also connected to the pneumatic pressure control panel 57 via the compressed air supply line 19. In addition, the air flow paths 25, 26 for the ring-like sealing members 5*a*, 5*b* are also connected to the pneumatic pressure control panel (compressed air supplying means) 57 via compressed air supply lines 58, 59.

A water detector 90 is provided in the watertight vessel 2 to detect whether or not the water exists in the watertight vessel 2. This water detector 90 is connected to a water detection device 92 via a signal line 91. The underwater TV camera 29 is connected to a controller 94 and a monitor 95 via a signal line 93.

Subsequently, procedures taken when the underwater inspection/repair apparatus 1A, 1B, 1C are installed in the reactor pressure vessel 62 and an auxiliary means used in such installation will be explained.

Figure 8:
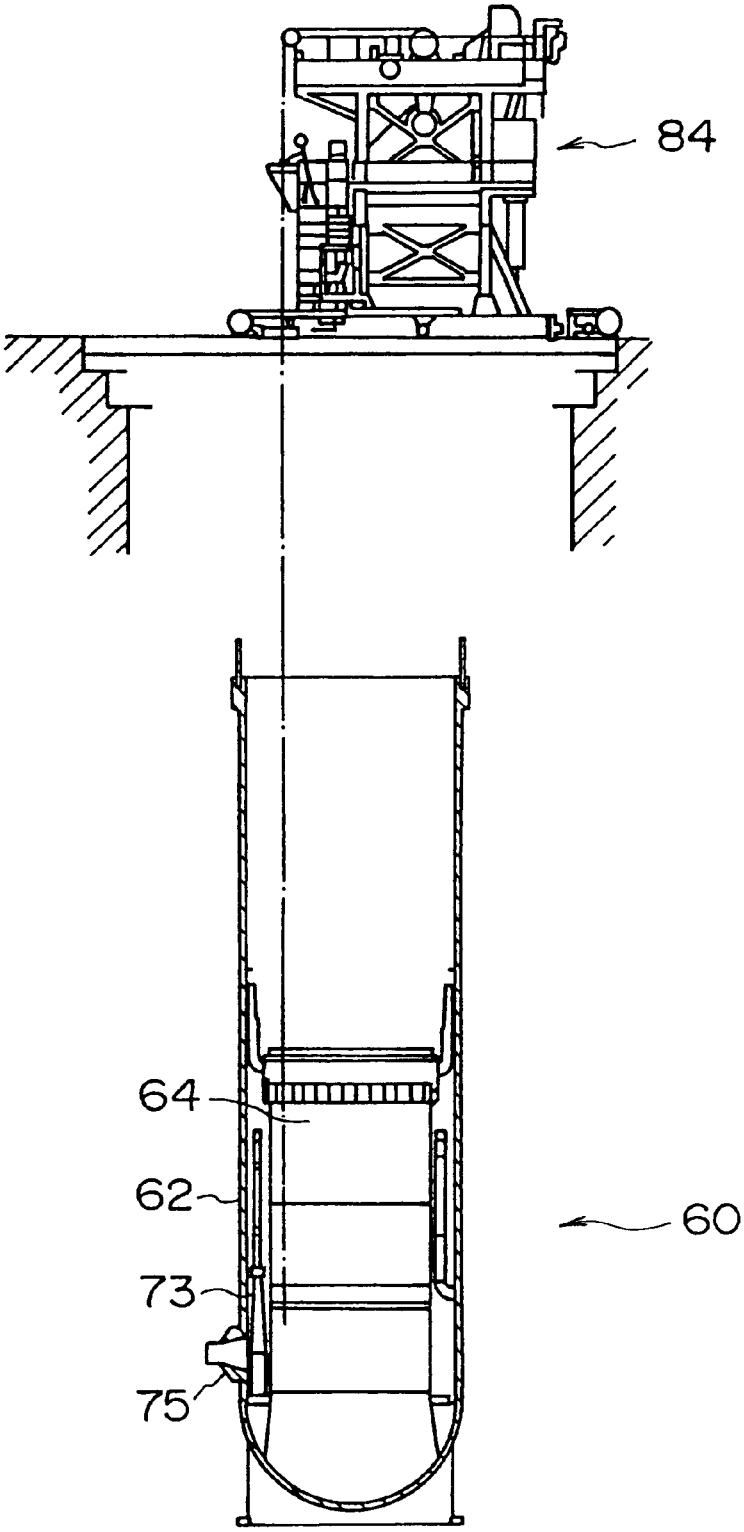
FIG. 8 is a view showing incore handling operations to be carried out when the reactor is shut down.

To begin with, in the state that the interior of the reactor pressure vessel 62 is filled with the core water (i.e., the reactor well filled state), the radiation shield device 100 shown in FIG. 1 is hung down in the reactor pressure vessel 62 by using an auxiliary hoist of the fuel exchanger 84 (see FIG. 8) and then shifted between the core shroud 72 and the reactor pressure vessel 62. The radiation shield device 100 has a radiation shield body 101 formed of lead, etc. A hook member 103 is fitted to the top end of the radiation shield body 101 by means of a connection rod 102.

The radiation shield device 100 can be positioned at a predetermined position by virtue of a bracket 72*a* of the core shroud 72, and then the radiation shield device 100 can be fixed to the predetermined position by hooking the hook member 103 onto a top end of the core shroud 72. Therefore, the radiation shield device 100 can be temporarily provided as the reactor internal structure.

After the radiation shield device 100 has been installed in the core in this way, the lowermost underwater inspection/repair apparatus 1C is hung down in the reactor pressure vessel 62 by using the auxiliary hoist of the fuel exchanger 84 and then shifted to the clearance between the reactor pressure vessel 62 and the radiation shield body 101. Then, the position of the lowermost underwater inspection/repair apparatus 1C can be adjusted by operating the auxiliary hoist while monitoring the image on the underwater TV camera 29. Thus, the lowermost underwater inspection/repair apparatus 1C can be positioned at the position facing to the third through pressure-vessel nozzle 78*c*.

After the lowermost underwater inspection/repair apparatus 1C has been positioned at the predetermined position, the output rods 9 can then be protruded toward the outer peripheral surface of the radiation shield body 101 serving as a supporting structure by supplying the hydraulic pressure from the hydraulic pressure control panel 54 to the supply ports 10 of the fluid pressure cylinders 7 via the hydraulic pressure supply line 53. At the time when the top ends of the output rods 9 are pushed against the outer peripheral surface of the radiation shield body 101, reaction forces against the fluid pressure cylinders 7 are generated. Then, the lowermost underwater inspection/repair apparatus 1C is pushed toward the inner wall surface 62*a* of the reactor pressure vessel 62 as a whole by virtue of the reaction forces.

At that moment, a pair of ring-like sealing members 5*a*, Sb provided on the top end portion 4*a* of the sealing device 4 are pushed against the inner wall surface 62*a* of the reactor pressure vessel 62, so that the inside of the watertight vessel 2 can be sealed and watertightly isolated from the outside. In addition, in order to increase the sealing effect of the sealing device 4, the compressed air is supplied to the clearance between the sealing members 5*a*, 5*b* and the back side of the sealing member 5*b* via the compressed air supply lines 58, 59 and the air flow paths 25, 26.

Moreover, as a back-up used when the pushing operation by the output rods 9 of the fluid pressure cylinders 7 is lost due to any cause, the actuating rod 27*c* of the mechanical jack 27 is rotated and operated by an actuating tool (wrench) from the upper side of the reactor, and then the top end of the pushing rod 27*a* is pushed against the outer peripheral surface of the radiation shield body 101 by moving forward the pushing rod 27*a*.

After the inside of the watertight vessel 2 has been sealed in this manner, the compressed air is supplied from the pneumatic pressure control panel (compressed air supplying means) 57 to the inside of the watertight vessel 2 via the compressed air supply port 19 and the compressed air supply port 18 and simultaneously the compressed air is supplied to the pneumatic water discharge pump 11 via the working air supply lines 17*a*, 17*b* and the working air supply ports 44, 45, so that the pneumatic water discharge pump 11 can be driven.

At that time, the core water in the watertight vessel 2 can be discharged to the outside by means of the pressure of the compressed air via the discharge port 20 formed at the bottom of the watertight vessel 2 and the core water discharge line 21, and sucked into the pneumatic water discharge pump 11 via the core water suction portion 12 and the suction line 13 and then discharged to the outside via the water discharge line 16. In this manner, the inside of the watertight vessel 2 can be filled with the compressed air to thus form the air space.

As a modification, the output rods 9 of the fluid pressure cylinders 7 may be directly pushed against the core shroud 72 as the supporting structure in place of the radiation shield body 101 of the radiation shield device 100.

Next, the case will be explained hereinbelow where the uppermost underwater inspection/repair apparatus 1A and the middle underwater inspection/repair apparatus 1B are installed at upper positions of the reactor pressure vessel 62 in order to inspect/repair the through pressure-vessel nozzles 78*a*, 78*b* which are positioned higher than the position of the core shroud 72. In this case, first the temporary reactor internal structure 104 shown in FIG. 1 is hung down in the inside of the reactor pressure vessel 62 and then installed therein.

As shown in FIG. 1, the temporary reactor internal structure 104 has upper and lower ring-shape members 105. Such ring-shape members 105 are connected to each other at a predetermined distance in the vertical direction. A plurality of receiving plates 107 and a plurality of fixing jacks 108 are provided to these ring-shape members 105. Installing positions of the receiving plates 107 for the ring-shape members 105 are set such that the receiving plates 107 face to the positions of the through pressure-vessel nozzles 78*a*, 78*b* when the temporary reactor internal structure 104 is installed in the reactor pressure vessel 62.

In addition, a plurality of hooking arms 109 are provided to the upper ring-shape member 105. Each of the hooking arms 109 has a fitting portion 110 which is fitted into the bracket 85 projected from the inner wall surface 62*a* of the reactor pressure vessel 62. A position adjusting bolt 111 is screwed into the top portion of the fitting portion 110.

In FIG. 1, a reference 86 denotes a guide rod which is fixed to the inner wall surface 62*a* of the reactor pressure vessel 62. The guide rod 86 acts as a guide used when the temporary reactor internal structure 104 is hung down in the inside of the reactor pressure vessel 62. Then, after the fitting portion 110 is fitted into the bracket 85, height and leveling of the temporary reactor internal structure 104 can be adjusted by operating the position adjusting bolt 111.

Then, the actuating portions 108*a* of the fixing jacks 108 are rotated by using the wrench via the fuel exchanger 84, and then the top ends of the fixing jacks 108 are pushed against the inner wall surface 62*a* of the reactor pressure vessel 62 by moving forward the pushing rods 108*b* of the fixing jacks 108, whereby the temporary reactor internal structure 104 can be fixed in the inside of the reactor pressure vessel 62.

After the temporary reactor internal structure 104 has been installed in the reactor pressure vessel 62, the middle underwater inspection/repair apparatus 1B is hung down in the inside of the reactor pressure vessel 62 by using the auxiliary hoist of the fuel exchanger 84 and then moved to the clearance between the reactor pressure vessel 62 and the receiving plate 107. Then, the position of the middle underwater inspection/repair apparatus 1B can be adjusted by operating the auxiliary hoist while monitoring the image on the underwater TV camera 29. Thus, the middle underwater inspection/repair apparatus 1B can be positioned at the position facing to the second through pressure-vessel nozzle 78*b*.

Then, the top ends of the output rods 9 are pushed against the outer peripheral surface of the receiving plate 107 by driving the fluid pressure cylinders 7 of the middle underwater inspection/repair apparatus 1B. Like the case in the lowermost underwater inspection/repair apparatus 1C, the air space can be formed in the watertight vessel 2. The uppermost underwater inspection/repair apparatus 1A can also be installed in the reactor pressure vessel 62 in the same way as the middle underwater inspection/repair apparatus 1B.

As described above, after the underwater inspection/repair apparatus 1A, 1B, 1C have been set and the air spaces have been formed in the insides of them, for example, inspection/repair operations such as welding, working, inspection, etc. can be applied to the through pressure-vessel nozzles 78*a*, 78*b*, 78*c* and their peripheral portions from the outside of the reactor pressure vessel 62.

As stated earlier, according to the underwater inspection/repair apparatus according to the present embodiment, since the air spaces can be formed locally near the through pressure-vessel nozzles 78*a*, 78*b*, 78*c* and their peripheral portions under the condition that the interior of the reactor pressure vessel 62 is filled with the core water, not only can the inspection/repair operations of the through pressure-vessel nozzles 78*a*, 78*b*, 78*c* and their peripheral portions be carried out in a short time without fail, but also an amount of radiation exposure of the operator can be significantly reduced.

According to the underwater inspection/repair apparatus according to the present embodiment, since the pneumatic water discharge pump 11 having an extremely high water discharge efficiency has been provided in the watertight vessel 2, the core water in the watertight vessel 2 can be firmly discharged in a short time and in turn a working efficiency can be widely improved.

Furthermore, according to the underwater inspection/repair apparatus according to the present embodiment, since the temporary reactor internal structure 104 is installed in the reactor pressure vessel 62 and also the uppermost underwater inspection/repair apparatus 1A and the middle underwater inspection/repair apparatus 1B are installed in the reactor pressure vessel 62 by using the temporary reactor internal structure 104, the uppermost underwater inspection/repair apparatus 1A and the middle underwater inspection/repair apparatus 1B can be provided with no trouble to the through pressure-vessel nozzles 78*a*, 78*b*, which are positioned higher than the core shroud 72.

As described above, according to the underwater inspection/repair apparatus according to the present invention, after the inside of the watertight vessel is isolated in a watertight manner by pushing the top end of the sealing device against the inner wall surface of the water vessel as the inspection object, the water in the inside of the watertight vessel can be discharged by the water discharge pump and the compressed air supply means to thus form the air space locally. Therefore, the inspection/repair operations can be carried out under the condition that the inside of the water vessel is filled with the water. As a result, not only can the inspection/repair operations be carried out in a short time without fail, but also an amount of radiation exposure of the operator can be significantly reduced under the radiation environment.

What is claimed is:

1. An underwater inspection/repair apparatus comprising:

a watertight vessel formed by a hollow member;

an opening portion formed on the watertight vessel;

a sealing device provided around the opening portion;

a pushing mechanism provided to the watertight vessel;

a water discharge pump for discharging water in an inside of the watertight vessel; and a compressed air supplying means for supplying a compressed air into the inside of the watertight vessel;

wherein the pushing mechanism has a pushing member which can be pushed against a supporting structure positioned behind a back surface of the sealing device, and a top end portion of the sealing device is pushed against an inner wall surface of a water vessel as an inspection object by a reaction force generated when the pushing member is pushed against the supporting structure, whereby the inside and an outside of the watertight vessel can be isolated in a watertight manner so that an inside condition of the watertight vessel can be changed and maintained in a dry condition.

2. The underwater inspection/repair apparatus according to claim 1, wherein the water discharge pump is made up of a pneumatic water discharge pump provided to the watertight vessel.

3. The underwater inspection/repair apparatus according to claim 2, wherein the pneumatic water discharge pump includes a pneumatic pressure cylinder driven by a pneumatic pressure, and a water discharge cylinder cooperated with the pneumatic pressure cylinder, and a water which is sucked into the water discharge cylinder from the inside of the watertight vessel is discharged to the outside of the watertight vessel by reciprocating the pneumatic pressure cylinder as well as the water discharge cylinder.

4. The underwater inspection/repair apparatus according to claim 3, wherein the pneumatic water discharge pump has a piston rod which is commonly used as the pneumatic pressure cylinder and the water discharge cylinder, and an air connecting flow path for connecting a pushing side internal space of the pneumatic pressure cylinder and a pushing side internal space of the water discharge cylinder is formed in the piston rod to enhance a pump operating efficiency of the pneumatic water discharge pump.

5. The underwater inspection/repair apparatus according to claim 3, wherein the water discharge cylinder has a suction side check valve and a discharge side check valve for regulating a water flow in an opposite direction respectively, and the water in the inside of the watertight vessel can be sucked into an inside of the water discharge cylinder via the suction side check valve and then discharged to the outside of the watertight vessel via the discharge side check valve.

6. The underwater inspection/repair apparatus according to claim 3, wherein a compressed air for driving the pneumatic pressure cylinder is supplied via a switching valve which is switched by a switching operation generated by a timer.

7. The underwater inspection/repair apparatus according to claim 1, wherein the sealing device is detachably attached to the watertight vessel.

8. The underwater inspection/repair apparatus according to claim 1, wherein the top end portion of the sealing device is formed to be curved in answer to a curved shape of the inner wall surface of the water vessel as the inspection object, a plurality of ring-shape sealing members are provided in a concentric manner to the top end portion, and a pneumatic pressure sealing is formed by supplying a compressed air into a space between the sealing members.

9. The underwater inspection/repair apparatus according to claim 1, wherein the pushing mechanism is made up of a fluid pressure cylinder, and the pushing member comprises an output rod of the fluid pressure cylinder.

10. The underwater inspection/repair apparatus according to claim 9, wherein the pushing mechanism further comprises a mechanical jack, which has a pushing rod which can be driven mechanically back and forth relative to the supporting structure, as back-up means used when a pushing operation generated by the output rod of the fluid pressure cylinder is lost.

11. The underwater inspection/repair apparatus according to claim 1, wherein the water vessel as the inspection object is a reactor vessel and has further a radiation shield body arranged in a clearance between an outer peripheral surface of a core shroud and an inner wall surface of the reactor vessel, and the pushing member of the pushing mechanism is pushed against a surface of the radiation shield body arranged at a predetermined position in the reactor vessel.

12. The underwater inspection/repair apparatus according to claim 1, further comprising a ring-shape member arranged in the water vessel as the inspection object, and a receiving plate fixed to the ring-shape member, and the pushing member of the pushing mechanism is pushed against a surface of the receiving plate of the ring-shape member which is arranged at a predetermined position in the water vessel as the inspection object.

13. The underwater inspection/repair apparatus according to claim 1, wherein a discharge port for discharging an air and the water in the watertight vessel is formed on the watertight vessel.

* * * * *